United States Patent [19]

Daenen

[11] 4,432,152

[45] Feb. 21, 1984

[54] PICTURE FRAME ARRANGEMENT

[75] Inventor: Robert H. C. M. Daenen, Hekelgem, Belgium

[73] Assignee: Dart Industries Inc., Northbrook, Ill.

[21] Appl. No.: 231,187

[22] Filed: Feb. 3, 1981

[51] Int. Cl.[3] ..... A47G 1/24

[52] U.S. Cl. ..... 40/152.1; 40/154; 40/155; 40/157

[58] Field of Search ..... 40/152.1, 152, 152.2, 40/153, 154, 155, 156, 157, 120, 574, 616, 578, 596

[56] References Cited

U.S. PATENT DOCUMENTS

| | | | |
|---|---|---|---|
| D. 240,492 | 7/1976 | Burin | D6/236 |
| 1,142,200 | 6/1915 | Orchard | 40/155 |
| 2,193,507 | 3/1940 | Carver | 40/596 |
| 2,784,511 | 3/1957 | Price | 40/156 |
| 2,833,071 | 5/1958 | Glass | 40/154 |
| 3,070,914 | 1/1963 | Henderson et al. | 40/156 |
| 3,181,869 | 5/1965 | Genin et al. | 40/154 |
| 3,557,480 | 1/1971 | Ebner | 40/152.1 |
| 3,579,886 | 5/1971 | Hughes | 40/152 |
| 3,688,897 | 9/1972 | Judd | 206/45.26 |
| 3,715,824 | 2/1973 | Rochman | 40/152 |
| 3,865,342 | 2/1975 | Kanzelberger | 40/152.1 |
| 4,017,989 | 4/1977 | Murray | 40/152 |
| 4,096,656 | 6/1978 | Diceglie | 40/564 |
| 4,193,521 | 3/1980 | Bounds | 222/142.4 |
| 4,203,239 | 5/1980 | Williams et al. | 40/124.2 |
| 4,216,936 | 8/1980 | DeSelms | 40/152.1 |
| 4,229,892 | 10/1980 | Hueter et al. | 40/152.1 |

*Primary Examiner*—Gene Mancene
*Assistant Examiner*—John Weiss

[57] ABSTRACT

A picture frame arrangement which contemplates employing a modular concept. Accordingly, a multiplicity of frames of the same or varying sizes may be arranged and interlocked together to create a desired picture collage. To achieve the interengagement between frames a unique hanger/holder has been conceived that overlies portions of the frames back surface and by means of a press-fit with integrally molded webs protruding from the mentioned frame back surfaces. The hanger/holder is further contemplated to be similarly attachable to a single frame or collage as a wall mounting or stand for the arrangement. Furthermore, each frame is provided with a reversible window that, in either position, press-fits into engagement with the frame's frontal surface to selectively retain either a typically thin picture or thicker collector type items.

10 Claims, 14 Drawing Figures

PICTURE FRAME ARRANGEMENT

This invention relates to a picture frame arrangement and more particularly to a frame construction that incorporates a modular concept. The construction furthermore contemplates the use of the window member that is reversible so as to be able to accommodate either the typically thin photograph or a collectable or raised surface display. The modularity of the concept enables the user to group one or more of the same size or different size frames together and to interconnect them with a unique clip type hanger/holder element.

It is, therefore, a principal objective of the invention to provide with a frame construction which has multiple facts and capabilities and will enable the user to flexibly employ a single and simple frame arrangement in a variety of manners.

Yet, another objective is to provide a simplified hanger/holder element which may be employed either to connect adjoining frames and/or to be used as a stand member for positioning a frame or frame collage on a planar surface and/or as a hanger for appropriately all mounting a frame arrangement.

Still another objective of the invention is to provide a frame structure that may be utilized with either the typical flat photograph or the thicker collectable type items.

These and other objects and advantages of this invention will become apparent from the following description when read in connection with the accompanying drawings wherein.

Figure 1:
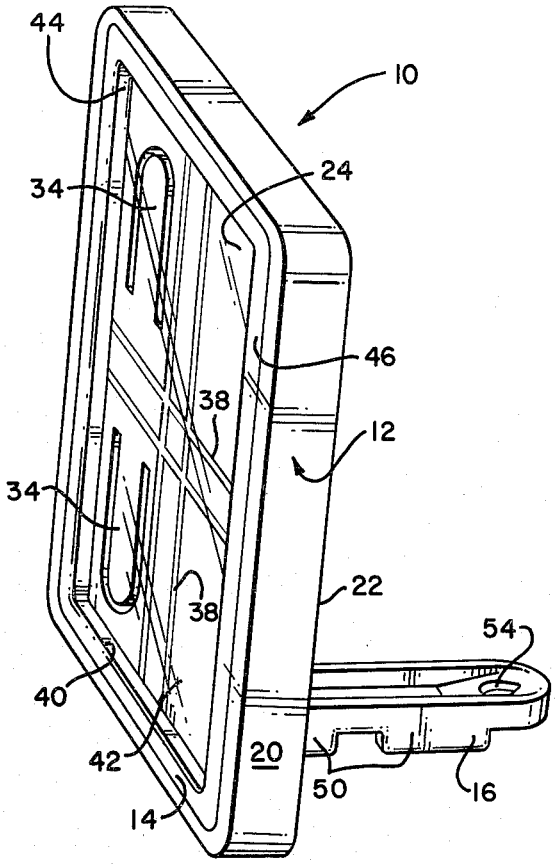
FIG. 1 is a top front perspective view illustrating typical a one of the frames of this invention.

Referring to the drawings the picture frame arrangement of the invention is indicated generally by the numeral (10) and such incorporates in its construction a frame (12), window (14) and hanger/holder (16). More particularly referring to FIGS. 1, 2 and 5 it may be seen that the frame (12) includes a principal support member (20) that is adapted to back whatever photograph or collectable may be positioned thereagainst for viewing. This member (20) incorporates a frontal side (24) in a rearward side (26) and is peripherally surrounded by the integral boundary element (22) which will be described in more detail hereinafter.

Figure 9:
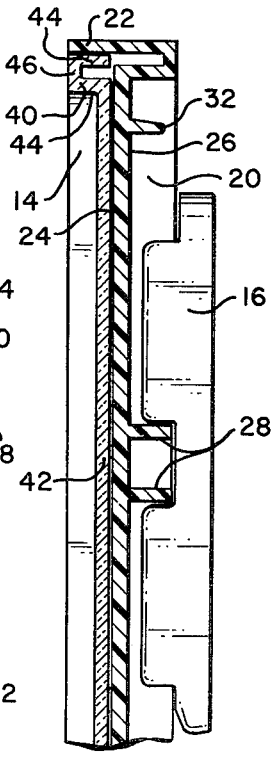
FIG. 9 is a partial cross-sectional view taken along line 9—9 of FIG. 6 and more vividly displays the positioning (a) of the window element within the frame such that it will position and securely hold a typical photograph and (b) of the hanger/holder element.
Figure 13:
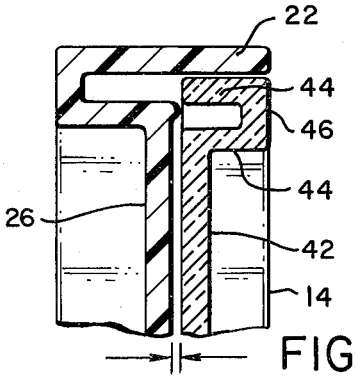
FIGS. 13 and 14 are partial cross-sectional views similar to that of FIG. 9 showing the window element in its alternate positions so as to be suitable for retaining either photographs or collectables within the frame recess.
Figure 14:
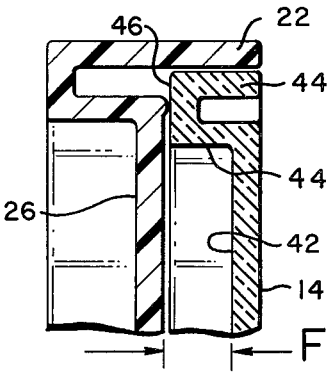

The construction of the boundary element (22) and its association with support member (20) is more vividly displayed in FIGS. 9, 13 and 14 where such can be seen to take "J"-shaped configuration. The shorter leg of that "J" can be seen to be interconnected with the periphery of the support member (20) while the longer leg is postioned as the exterior wall of the frame arrangement (10). Furthermore, the short leg of the "J" extends outwardly from the rearward side (26) of support member (20) while the longer side of the "J" extends outwardly beyond the frontal side (24). Accordingly, this also produces a frame recess between frontal side (24) and the outer most frontal edge of the boundary element (22). This boundary construction thereby lends a flexibility to the element (22) so that it may act in a spring-like manner against peripheral the edges of the window (14) when in association with the frame.

Figure 3:
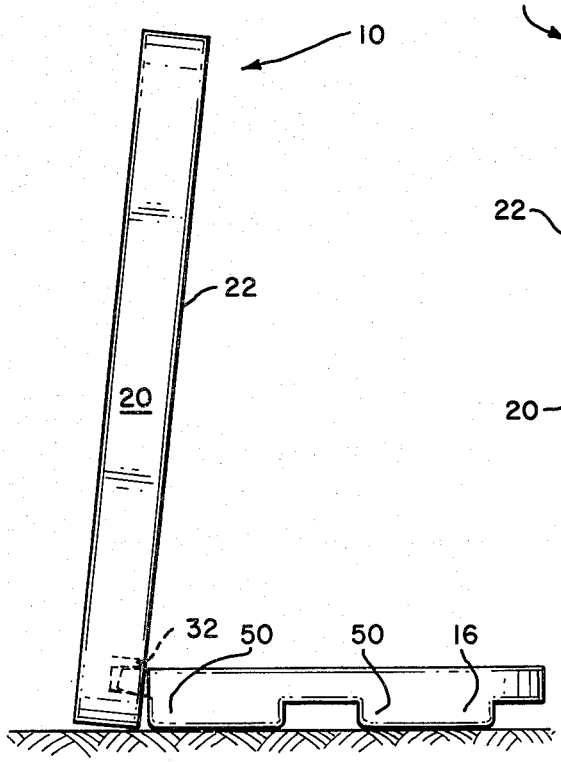
FIG. 3 is a side elevational view of the frame shown in FIGS. 1 and 2.
Figure 4:
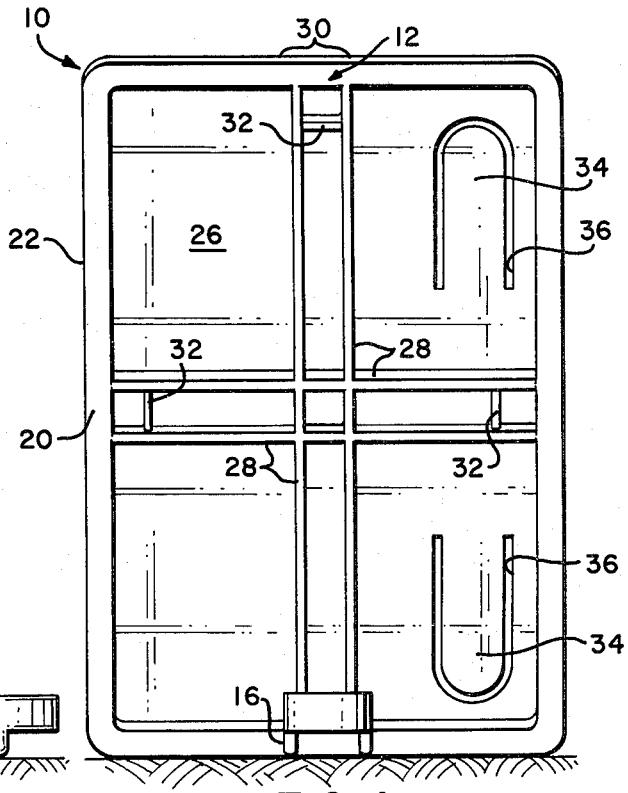
FIG. 4 is a rear elevational view of the same frame.

The principal support member (20) also includes projecting means (28) which take the form of parallel webs and which are juxtaposed to the imaginary center lines of the frame (12). These webs (28) are integrally connected with the rearward side (26) of support member (20) and with the shorter leg of the "J"-shaped element (22) of frame (12) at opposed areas designated as numerals (30). Such, therefore, produce a rearwardly facing channel-like network as is apparent in FIG. 2 which intersect with the boundary element (22). Each of these channels at points juxtaposed to the shorter leg of the "J" side of boundary element (22) have tabs (32) extending either entirely or partially across their interior extents. These tabs (32) function to firmly support the hanger/holder (16) in its association with frame (12), as may best be seen in FIGS. 2, 3 and 4 so that the frame may be conveniently stood on a generally planar support surface. This aspect of the invention will also be discussed more fully hereinafter.

The principal support member (20) is also preferably modified in several locations as to include a finger depressible element (34). This element (34) is formed by the inclusion of a narrow slot (36) which extends entirely through the support member (20) from the frontal side (24) to the rearward side (26) thereof. It is intended that this means (element 34) may be employed to displace the window (14) and/or mounted photo or other collectable from engagement with frame (12).

Also please note that the frontal side (24) of member (20) incorporates a series of ribs (38) which are only slightly raised above the plane of frontal side (24) and which correspond in position to the webs (28) that project from the rearward side (26) thereof. THese ribs (38) are intended to slightly elevate and separate an encased photograph or the like from intimate uninterrupted conctact with the entirety of frontal side (24) of the support member (20) and thereby assure that such photograph will not become affixed too rigidly to the mentioned frontal side (24).

Figure 5:
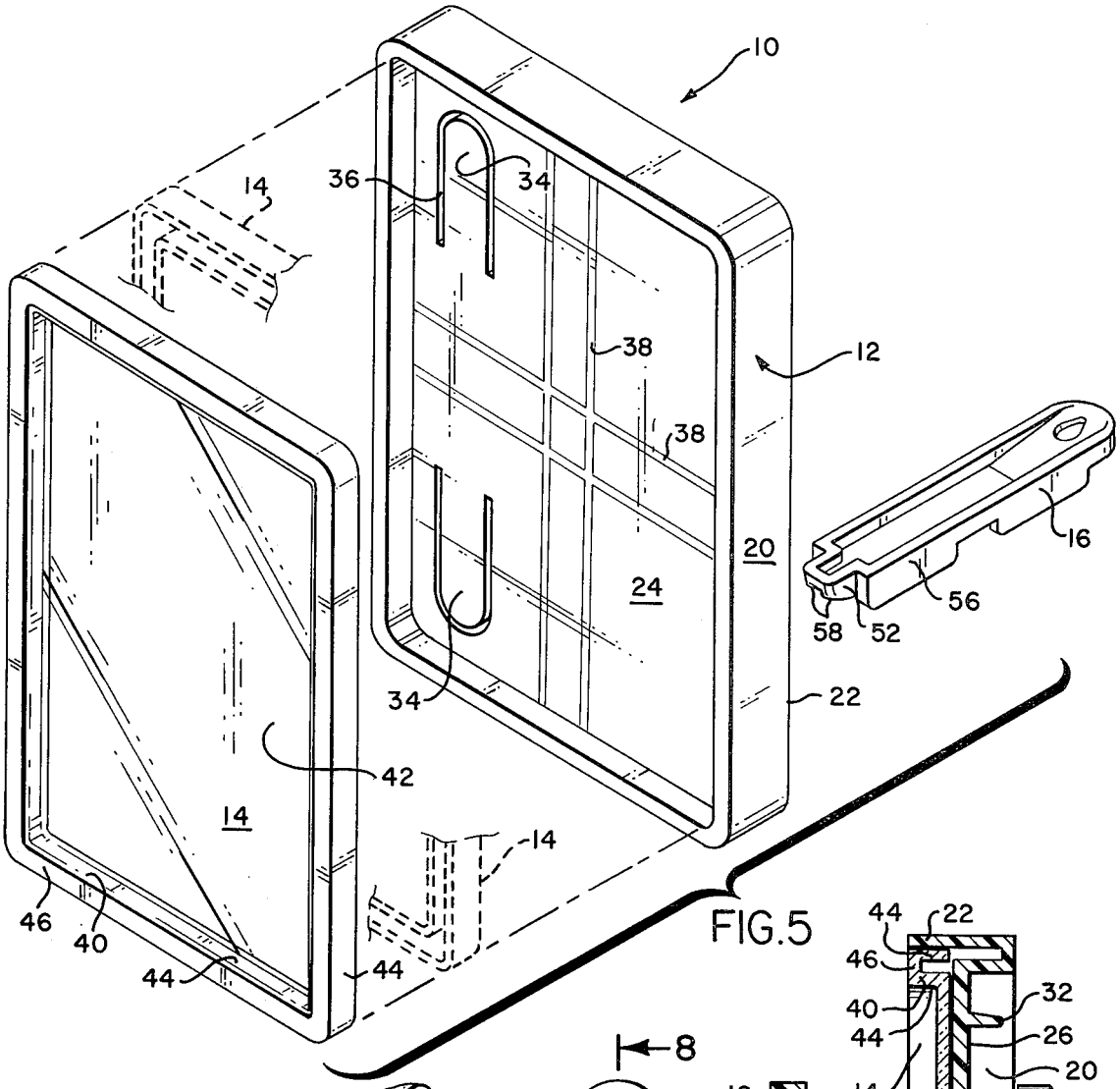
FIG. 5 is an exploded front perspective view of the various frame arrangement elements and includes a partial phantom section illustrating the reversibility of the window member of the group.
Figure 10:
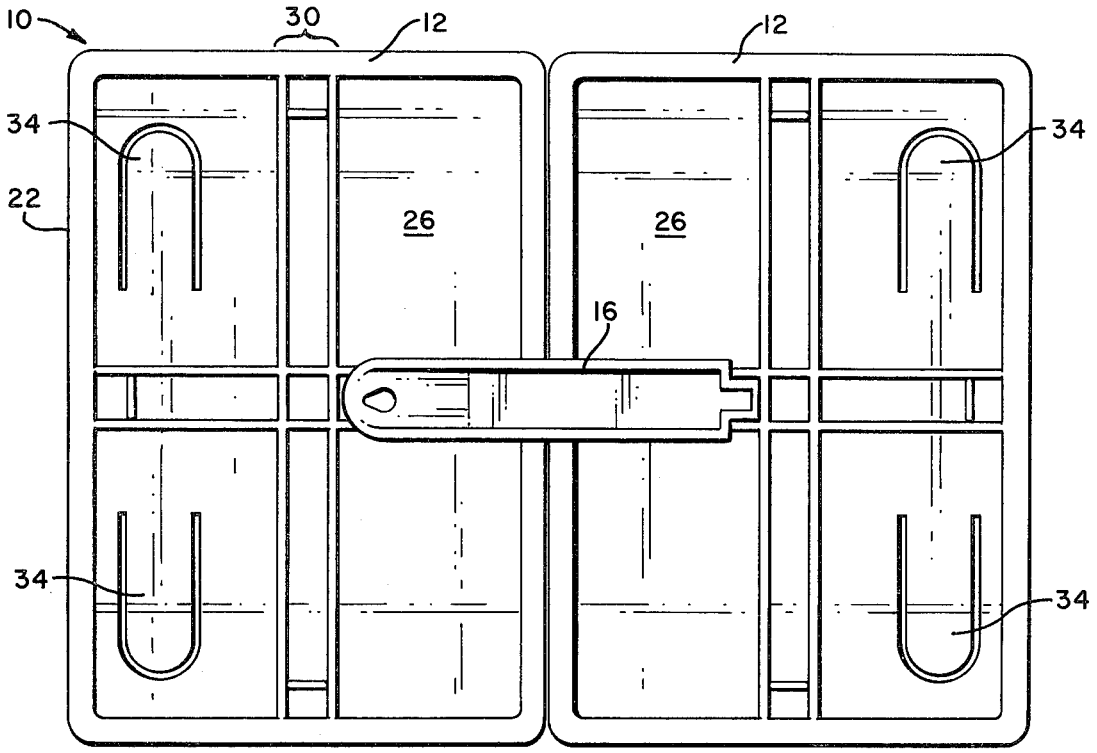
FIG. 10 is an elevational view showing two frames of similar size interconnected one to the other by a hanger/holder element.

The window (14) as can best be seen in FIGS. 5, 9 and 10 includes a peripheral rim (40) formed by an upstanding "U"-shaped member having wall legs (44) and an interconnecting wall (46). The rim (40) bounds the principal translucent surface or viewing area (42) of the window and is interconnected with the innermost wall leg (44) at its lowermost extent. As can be appreciated from FIGS. 5, 9, 13 and 14 the "U"-shaped construction of the peripheral rim (40) also lends flexibility (spring-like action) to the rim (40). Ths enhances the effect of the press-fit interengagement thereof with the "J"-shaped boundary element (22) of frame (12). Thus, when the window is positioned as shown in FIGS. 9 and 10 it is assured of being firmly maintained in appropriate contact with the frame (12). Furthermore, as is apparent from these figures, the window again due to the "U"-shaped configuration of the rim provides for either a very close juxtaposition of the principal or viewing surface (42) to the frontal side (24) of frame (20) or such may be positioned in a more remote location from that frontal side (24) so that a variety of collectables may be appropriately mounted in the frame arrangement (10).

Accordingly, in the FIGS. 9 and 13 configuration of this invention, either pictures, photographs, drawings, postcards, reproductions, other art work or the like may be mounted for viewing. Contrary to that arrangement one may reverse the window as is illustrated in FIG. 14 and small flat collectors items such as coins, medallions, dried flowers, butterflies or the like may be mounted within the frame. This, therefore, lends substantial flexibility to the user and affords him with a single frame arrangement the possibility of multiple uses therefor.

Figure 6:
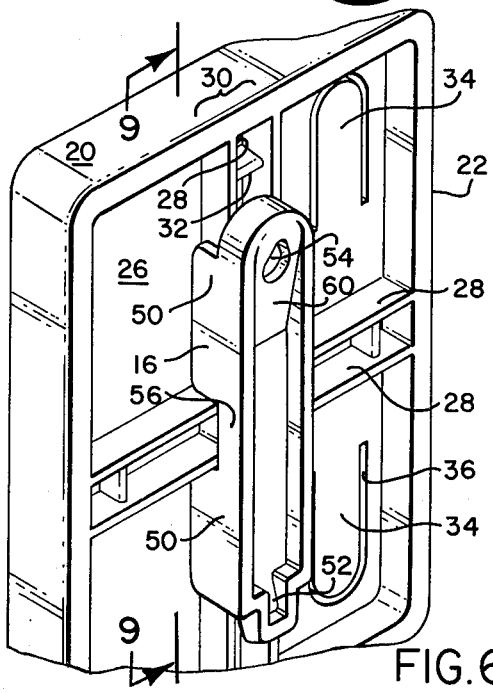
FIG. 6 is a partial rear perspective view of the frame showing the hanger/holder member press-fit against the rear of the frame in a position to accommodate wall mounting of the frame.
Figure 7:
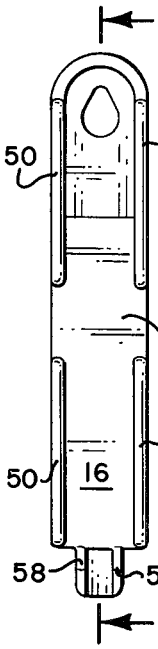
FIG. 7 is a top plan view of the hanger/holder element.
Figure 8:
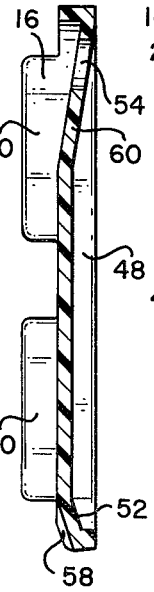
FIG. 8 is a cross-sectional view taken along line 8—8 of FIG. 7 and illustrates more vividly the constructional aspects of the hanger/holder.

The hanger/holder (16) as best may be seen in FIGS. 7, 8 and 9 is comprised of an elongate body portion (48) one portion of which includes a canted area (60) which in turn incorporates an opening (54) therein. The mentioned body portion (48) furthermore displays a surrounding wall (56) which nominally depends from the underside of portion (48) and has spaced apart discontinuous elements (50) oppositely projecting from the surrounding wall (56). The discontinuity of these elements (50) is of an approximately equivalent extent to that distance between the exteriors of the parallel webs (28) of frame (12). Likewise, the transverse space between the elements (50) i.e., interior distance between elements (50), is also the approximate distance between the mentioned exterior surfaces of webs (28). This structural sizing enables the user to easily, yet firmly, clip the hanger/holder (16) to the rear of the frame (12) in the position as shown in FIG. 6 so that the opening of (54) is positioned adjacent the upper portion of the frame and so that such frame can be wall mounted on a typical picture hanger type element.

Furthermore, due to the unique construction above described this same hanger/holder may be used to clip frames of similar of different sizes together to form a collage. Such an arrangement can be seen in FIG. 10 where the mentioned hanger/holder (16) is attached to frames of similar size and the openings (discontinuous areas) in the spaced apart elements (50) bridgess the abutted boundary elements (22) of adjacent frames (12). Accordingly, it is clearly apparent that the boundary elements mentioned are of a width approximating one half that of the exterior distance between webs (28).

Although not shown, it is contemplated that frames of varying sizes may be grouped together so long the same incorporate the constructional features hereabove described. The only requirement being that such be modularly designed.

Figure 2:
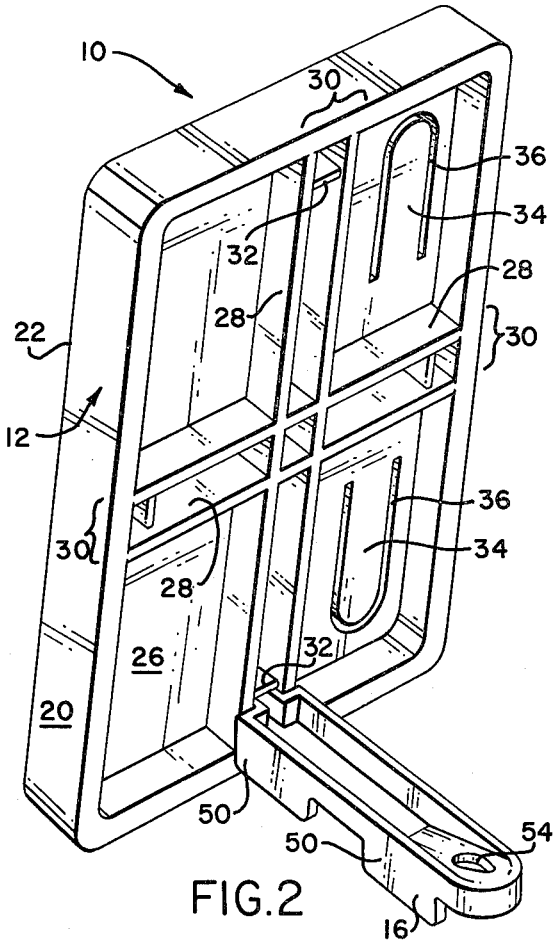
FIG. 2 is a top rear perspective view similar to that of FIG. 1.
Figure 11:
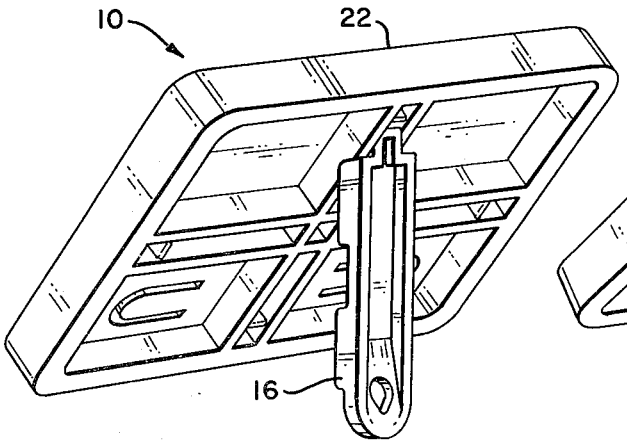
FIGS. 11 and 12 illustrate alternative positions that the hanger/holder may assume in supporting the typical frame of this invention.
Figure 12:
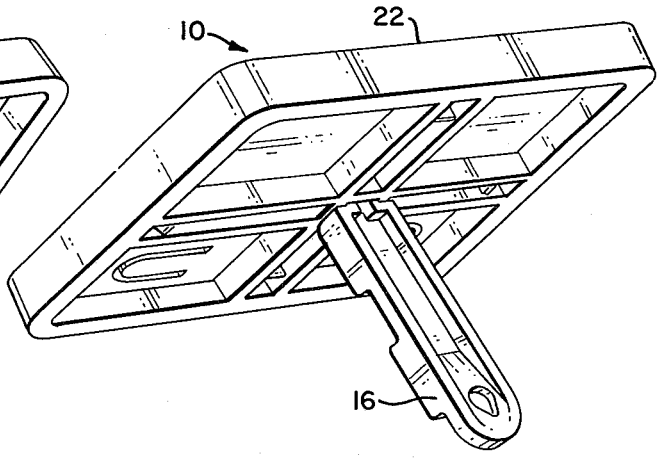

One further feature of the hanger/holder (16) is the incorporation, at the end opposite to that having the canted area (60) of a projecting tongue (52) from the body portion (48). This projecting tongue (52) includes on the outer edges of its upper surface raised lips (58) which together with the tongue are adapted to interengage the webs (28) and/or tabs (32) to effectively provide a standing support for the frame (12) as is shown in FIGS. 1 and 2 as well as FIGS. 11 and 12. These latter FIGS. 11 and 12 also illustrate that the mounting or use of the hanger/holder (16) may be such that frame (12) is supported at different angles on a table or other surface area.

Although the frames shown and described are rectangular, it will be appreciated that the invention is not restricted to this shape. Preferably, the portions of the frame that receive the hanger/holder do not deviate markedly from a straight line but the remaining portions may be curved as desired. Other modifications will occur to those skilled in the art and it is my intention to cover in such modifications that may be reasonable embraced by the appended claims.

I claim:

1. A picture frame arrangement comprising:

a frame having a planar principal support member of lateral and longitudinal extent and a peripherally extending boundary element projecting approximately perpendicularly from both the frontal and rearward surfaces of said support member;

first and second pairs of web means, each of said pairs in spaced parallel relationship extending in straight line fashion between opposed areas along said boundary element projecting substantially perpendicularly from the rearward surface of said support member, said first pair disposed laterally, and said second pair disposed longitudinally;

a plurality of tabs integral with said web means extending transversely between said first pair of web means and between said second pair of web means at positions juxtaposed to said boundary element;

a window positioned across the frontal side of said support member and including a peripheral rim that interengages said boundary element to retain the frame and window in a fixed yet separable, relationship; and a hanger/holder comprising an elongate body portion having a pair of opposed parallel sides, a pair of parallel spaced apart elements depending substantially perpendicularly from said body portion along said pair of sides, and a tongue projecting from an end of said body portion, said tongue and said spaced apart elements being selectively engageable with each of said pairs of web means to provide an appropriate means for supporting said frame arrangement atop a surface and hanging said frame arrangement on a wall.

2. A picture frame arrangement according to claim 1 wherein said principal support member includes means by which the window may be displaced from interengagement with said boundary element.

3. A picture frame arrangement according to claim 2 wherein said means by which the window may be displaced is a finger-depressible element formed within said support member by introduction of a narrow slot therethrough.

4. A picture frame arrangement according to claim 1 wherein the peripheral rim of said window is formed by an upstanding U-shaped member portions of which are engageable with the frontal side of said support member regardless of the orientation of said window when in fixed interengagement with said frame.

5. A picture frame arrangement according to claim 1 wherein said boundary element is integral with said support member and is of a J-shaped configuration such that the longer side thereof may flexibly interengage with the peripheral rim of said window.

6. A picture frame arrangement according to claim 1 wherein said first and second pairs of web means extend in juxtaposition with each centerline of said support member.

7. A picture frame arrangement according to claim 6 wherein said elongate body portion has an opening therethrough and said spaced-apart elements are discontinuous in nature.

8. A picture frame arrangement according to claim 7 wherein the extent of discontinuity of each of said spaced-apart elements is such that it bridges the extent of separation between said parallel web means.

9. A picture frame arrangement according to claim 1 wherein said first and second pairs of web means extend in juxtaposition with each centerline of said support member and said boundary element is of a J-shaped configuration the lateral extent of which approximates one-half the distance between webs.

10. A picture frame arrangement according to claim 1 wherein the frontal side of said support element displays a pattern of ribs that extend above the surface thereof.

* * * * *